US007543760B2

(12) United States Patent
Levy et al.

(10) Patent No.: US 7,543,760 B2
(45) Date of Patent: Jun. 9, 2009

(54) PORTABLE EVAPORATIVE SNOW APPARATUS

(76) Inventors: Frank Levy, P.O. Box 7125, Fort Meyers, FL (US) 33911; Francisco Javier Guerra, 3481 County Rd. 93, Anderson, AL (US) 35810

( * ) Notice: Subject to any disclaimer, the term of this patent is extended or adjusted under 35 U.S.C. 154(b) by 0 days.

(21) Appl. No.: 11/945,674

(22) Filed: Nov. 27, 2007

(65) Prior Publication Data

US 2008/0120992 A1 May 29, 2008

Related U.S. Application Data

(60) Provisional application No. 60/867,323, filed on Nov. 27, 2006.

(51) Int. Cl.
*F25C 3/04* (2006.01)
*F25J 1/00* (2006.01)

(52) U.S. Cl. ..... 239/2.2; 62/603; 239/14.2

(58) Field of Classification Search ..... 62/603, 62/347; 239/2.2, 14.7, 416.5, 423
See application file for complete search history.

(56) References Cited

U.S. PATENT DOCUMENTS

| | | | | | |
|---|---|---|---|---|---|
| 3,831,844 | A * | 8/1974 | Tropeano et al. | ..... | 239/14.2 |
| 3,879,703 | A * | 4/1975 | Bonazoli et al. | ..... | 340/689 |
| 5,154,348 | A * | 10/1992 | Ratnik et al. | ..... | 239/14.2 |
| 5,699,961 | A * | 12/1997 | Ratnik et al. | ..... | 239/14.2 |
| 6,164,556 | A * | 12/2000 | Dupre et al. | ..... | 239/14.2 |
| 6,295,007 | B1 * | 9/2001 | O'Meara | ..... | 340/953 |
| 6,402,047 | B1 * | 6/2002 | Thomas | ..... | 239/14.2 |
| 6,474,091 | B2 * | 11/2002 | Guerra | ..... | 62/347 |
| 2002/0174578 | A1 * | 11/2002 | Ross | ..... | 40/409 |
| 2006/0071091 | A1 * | 4/2006 | Ratnik | ..... | 239/14.2 |

* cited by examiner

*Primary Examiner*—William C Doerrler
(74) *Attorney, Agent, or Firm*—David W. Barman; Robert M. Schwartz

(57) ABSTRACT

An apparatus for producing evaporative snow having a snow generation unit including a fluid reservoir, a fluid delivery line and a snow generation tip; and a compressed gas unit including at least one container of compressed gas, a source of electric power, and a gas regulator valve.

12 Claims, 7 Drawing Sheets

PORTABLE EVAPORATIVE SNOW APPARATUS

INDEX TO RELATED APPLICATIONS

This application claims the benefit of U.S. Provisional Patent Application Ser. No. 60/867,323 filed Nov. 27, 2006 the disclosure of which is incorporated herein by reference in its entirety.

BACKGROUND OF THE INVENTION

Evaporative and illusionary snow systems have been described in U.S. Pat. Nos. 6,321,559; 6,474,090; 6,474,091; and 6,868, 691. These machines do not lend themselves to effectively producing evaporative and illusionary snow in a portable apparatus.

Specifically, previous machines required a flake generator incorporating and impeller and fan to project the flakes away from the apparatus.

The present invention utilizes Venturi effect to produce the flakes and protect them from the apparatus. DOS the present invention is simple or to manufacture and use because it does not require an impeller and incorporated fan with a flake generator in order to create evaporative snowflakes and propel them from the apparatus.

The Venturi effect is an example of Bernoulli's principle, in the case of incompressible fluid flow through a tube or pipe with a constriction in it. The fluid velocity must increase through the constriction to satisfy the equation of continuity, while its pressure must decrease due to conservation of energy: the gain in kinetic energy is supplied by a drop in pressure or a pressure gradient force.

The limiting case of the Venturi effect is choked flow, in which a constriction in a pipe or channel limits the total flow rate through the channel, because the pressure cannot drop below zero in the constriction. Choked flow is used to control the delivery rate of water and other fluids through spigots and other valves.

The portable apparatus of the present invention utilizes a source of compressed gas to produce in the desired pressure and airflow for the effective creation of evaporative snow.

BRIEF SUMMARY OF THE INVENTION

The present invention provides for a novel apparatus for producing evaporative snow. Evaporative snow solution is commercially available from Snowmasters® (Anderson, Ala.).

In one embodiment the present invention is an apparatus for producing evaporative snow comprising:

(a) a snow generation unit having a fluid reservoir, a fluid delivery line and a snow generation tip;

(b) a compressed gas unit having at least one container of compressed gas, a source of electric power, and the gas regulator valve.

The fluid reservoir contains the aforementioned evaporative snow solution. The compressed gas is any suitable compressed gas. Suitable compressed gases may include carbon dioxide, atmospheric air, nitrogen, helium, or mixtures thereof. The compressed gas is contained in one or more compressed gas containers.

The apparatus has source of electric power that may be delivered by batteries providing between about 3-24 volts.

The apparatus has a snow generation tip that includes a membrane providing a surface for the formation of evaporative snowflakes. The snow generation tip may be movable and non-movable portion on the second end of a fixed telescoping tip.

In a preferred embodiment, the gas regulator valve is an electronically activated solenoid.

Additionally preferred, the gas regulator valve is an electronically activated solenoid controlled by a tilt switch actuator.

The tilt switch actuator activates the solenoid when oriented at an angle 45° or greater relative to the horizontal plane.

In one embodiment, the present invention utilizes an air delivery system whereby the air is delivered by compressed gas. Any compressed gas can be used. Preferably, the compressed gas is selected from compressed ambient air, carbon dioxide, nitrogen, helium, or combinations thereof.

In one embodiment, the apparatus of the present invention includes compressed air storage, with a hose or other acceptable transport mechanism to deliver the compressed gas to the snow generation tip.

The snow generation tip includes a novel arrangement by which compressed air enters the first end of the snow generation tip, the interior of the snow generation tip has an inlet for providing evaporative snow solution to the tip, and the pressure produced with in the snow generation tip draws its solution from the inlet into the interior of the tip. The compressed air continues to travel towards the second end of the snow generation tip onto which a membrane is affixed. The membrane provides a surface at which the snow solution mixed with the compressed air forms and evaporative snow flakes. The compressed air passes through the membrane and lifts the flakes off the membrane outward from the snow generation tip. Thus, individualized evaporative snowflakes are discharged from the tip utilizing airflow generated by the compressed air.

In one embodiment, a user will utilize two separate units of the apparatus wherein a first unit includes at least one compressed air cylinder and a valve for controlling the release of compressed air from the cylinder. In one embodiment of valve for controlling the release of compressed air is an electronic solenoid. A second unit includes a snow generation tip. In a preferred embodiment, the snow generation tip is attached to the forearm of the user, such that evaporative snow may be direct a colinearly with the users forearm. In a preferred embodiment, the user will conceal the snow generation tip inside the forearm portion of a shirt sleeve. The second unit may additionally be placed in any prop, case, chair, table and the like.

Alternatively, the snow generation tip may be concealed such that those viewing the evaporative snow produced from the apparatus of the present invention to not readily ascertain the source of the evaporative snow they are viewing. In one embodiment, the snow generation tip may be concealed alongside a conventional microphone stand. The compressed air and evaporative snow generation solution may be concealed in the base of a microphone stands or alternatively may be delivered to the microphone stand by one or more hoses.

DETAILED DESCRIPTION OF THE PREFERRED EMBODIMENTS

Figure 1:
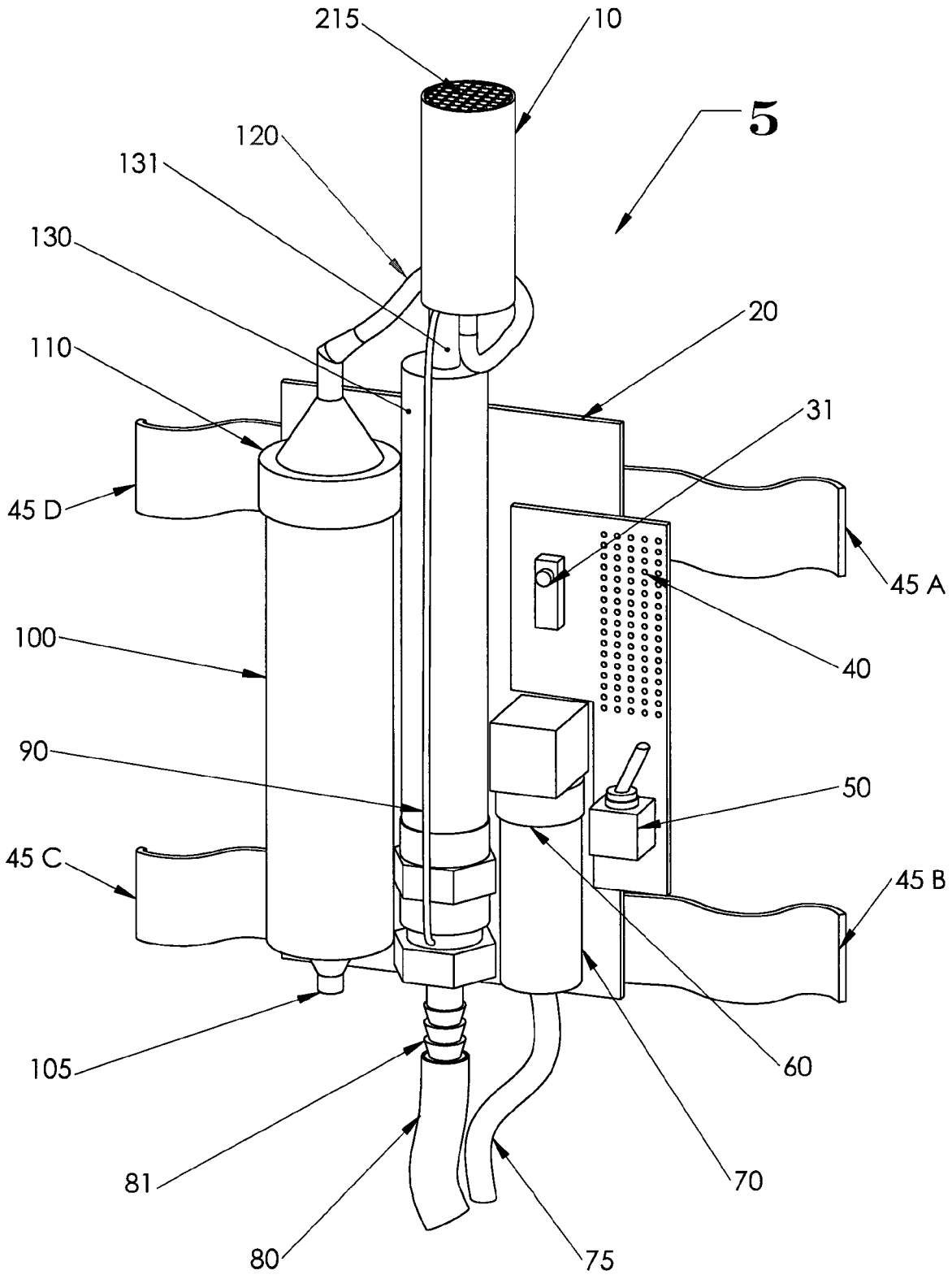
FIG. 1 is a site perspective view of the snow generating tip and snow solution reservoir of the present invention.
Figure 2:
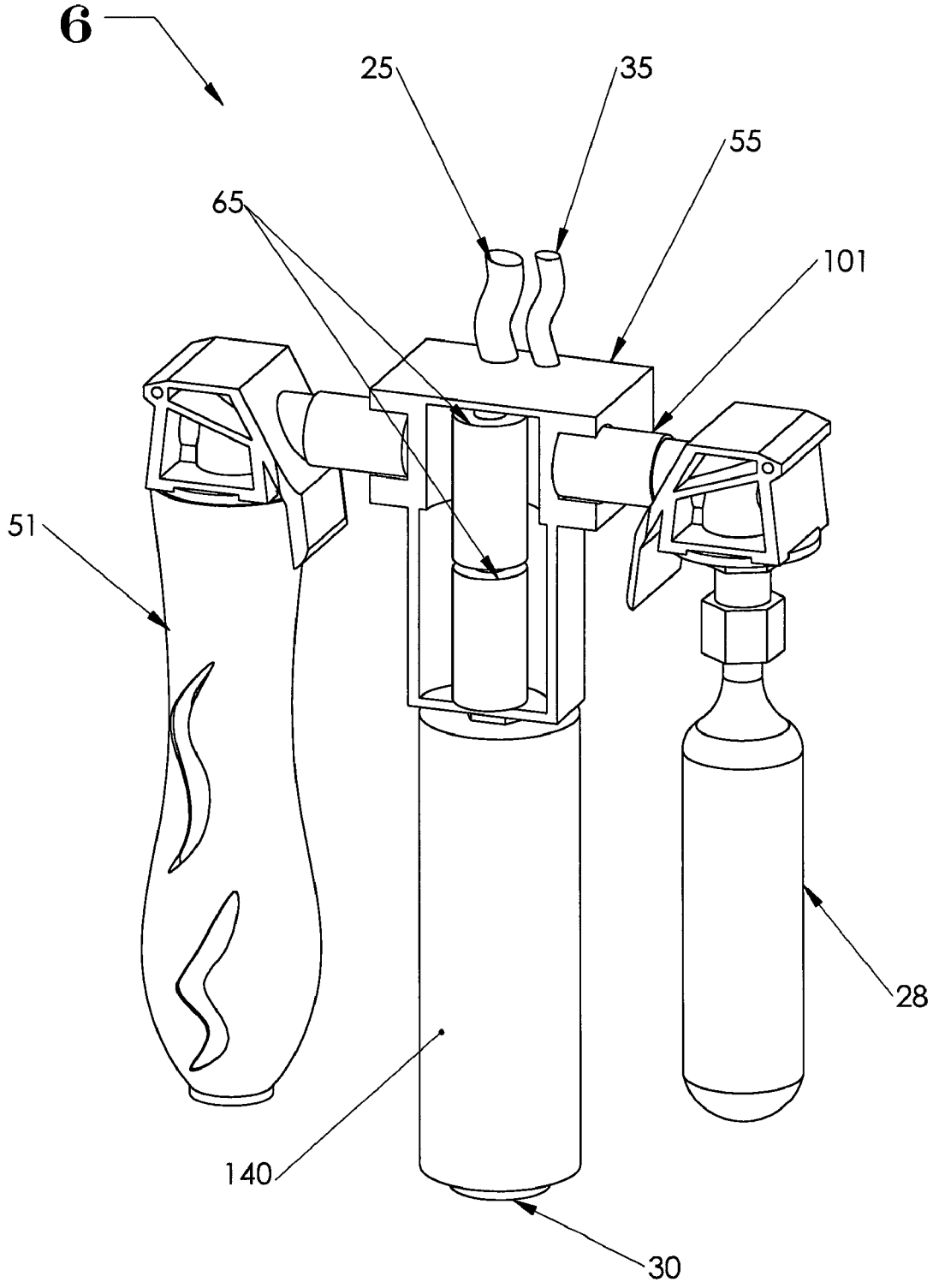
FIG. 2 is a site perspective view of an apparatus including compressed gas cylinders and a solenoid of the present invention.

Snow generation unit 5 is secured and attached to an arm band 20 that is secured to the forearm of a user by any appropriate mechanism. The securing may be by corresponding straps 45A with 45D, and 45B with 45C ties, Velcro, and the like. Snow generation unit 5 has an on/off toggle switch 50 that controls power delivery to an electronic solenoid 55 that regulate the delivery of compressed air. Electricity is transmitted by way of female receptacle 60 receiving male electrical connector 70 that has electrical wire 75 extending outward and terminating at solenoid 55 with electrical connector 35. Solenoid 55 is opened when tilt switch actuator 31 detects snow generation unit 5 in an orientation relative to horizontal of 45° or greater. When a user orients snow generation unit 5 with arms by their side, the tilt switch actuator will not engage electronic solenoid 55. When the user raises their arm in the air and orients snow generation unit 5 at an angle of 45° or greater, tilt switch actuator 31 engages solenoid 55 and releases compressed gas from compressed gas cylinder 28 housed within compressed gas cylinder housing 51.

Compressed gas unit 6 has at least one compressed gas cylinder 28. Preferably, compressed gas cylinder 28 is contained within a compressed gas cylinder housing 51. Compressed gas unit 6 has at least one battery 65 for providing electrical power by which solenoid 55 may be activated and the activated by tilt switch actuator 31. Compressed air unit 6 has an electrical wire 35 for providing necessary electricity to solenoid 55. Compressed air unit six also has an outlet air port 25 for transporting compressed gas from compressed air unit 6 to snow generation unit 5.

Snow generation unit 5 further includes a reservoir 100 having a one-way delivery valve 105 for filling reservoir 100 with evaporative snow solution. Reservoir 100 has a cap 110 with a solution delivery closed 120 that delivers evaporative snow solution to snow generation tip 10 affixed on one end of telescoping tip 130. Telescoping tip 130 has a first end configured with air hose inlet 81 to receive air supply hose 80. Telescoping tip 130 has a second end in which air outlet 131 connects to snow generating tip 10 such that snow generating tip 10 may slidably move along air outlet 131.

Snow generation tip 10 is configured to receive compressed gas from air hose inlet 230 that delivers compressed gas into lower chamber 235. Snow generation tip 10 also includes snow solution delivery line 225 that has outlet 220 delivering snow solution into upper chamber 240. Compressed gas traveling from lower chamber 235 to upper chamber 240 creates negative pressure inside the snow generation tip can such that evaporative snow solution exiting outlet 220 mixes with compressed gas and formed evaporative snowflakes on membrane 215. The force of the compressed gas traveling through snow generation tip 10 and exiting through membrane 215 lifts evaporative snowflakes outward from membrane 215 and projects the flakes away from snow generation tip 10.

Figure 3:
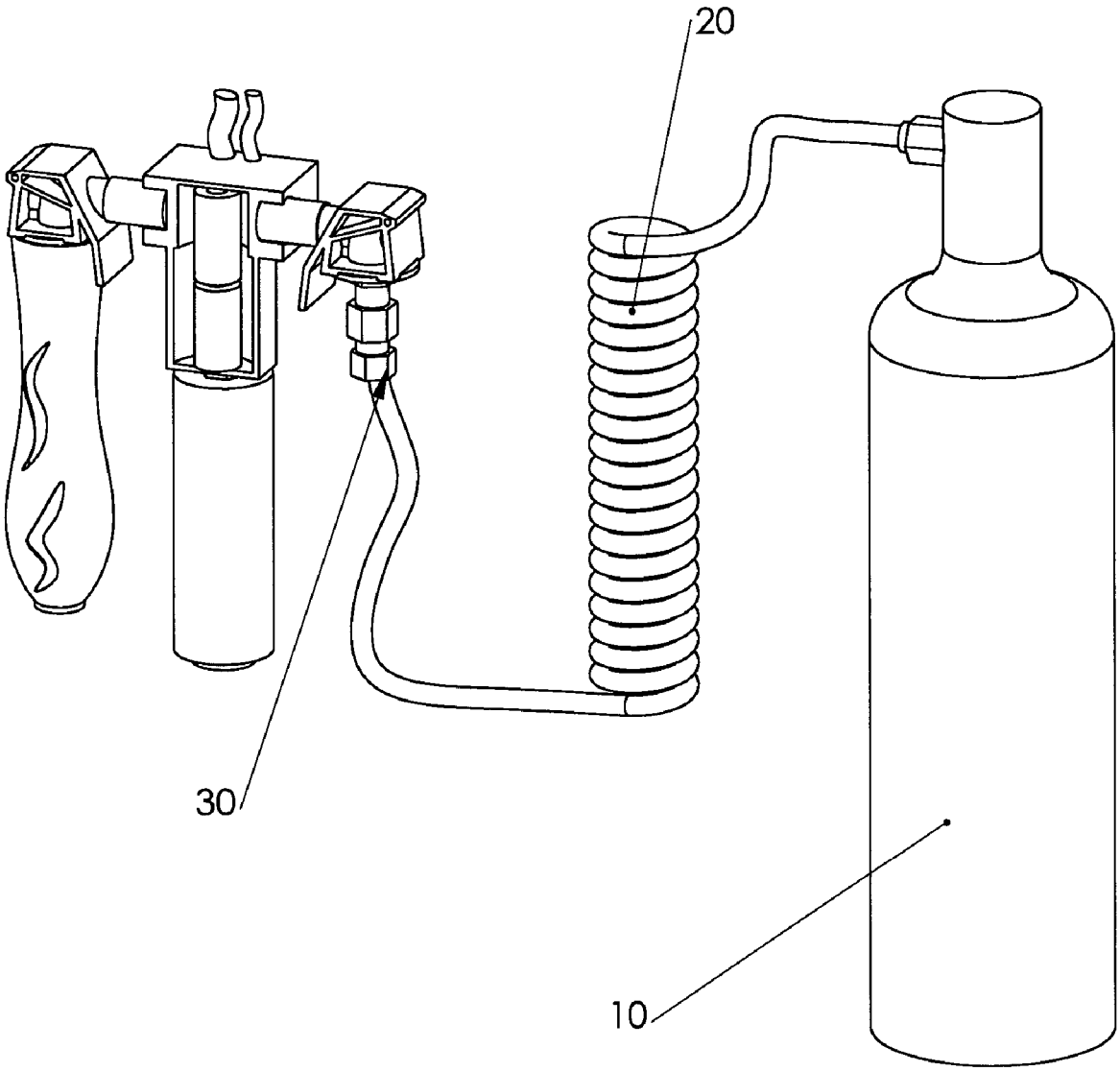
FIG. 3 is an alternative embodiment including a larger compressed gas cylinder connected to a solenoid of the present invention.
Figure 4:
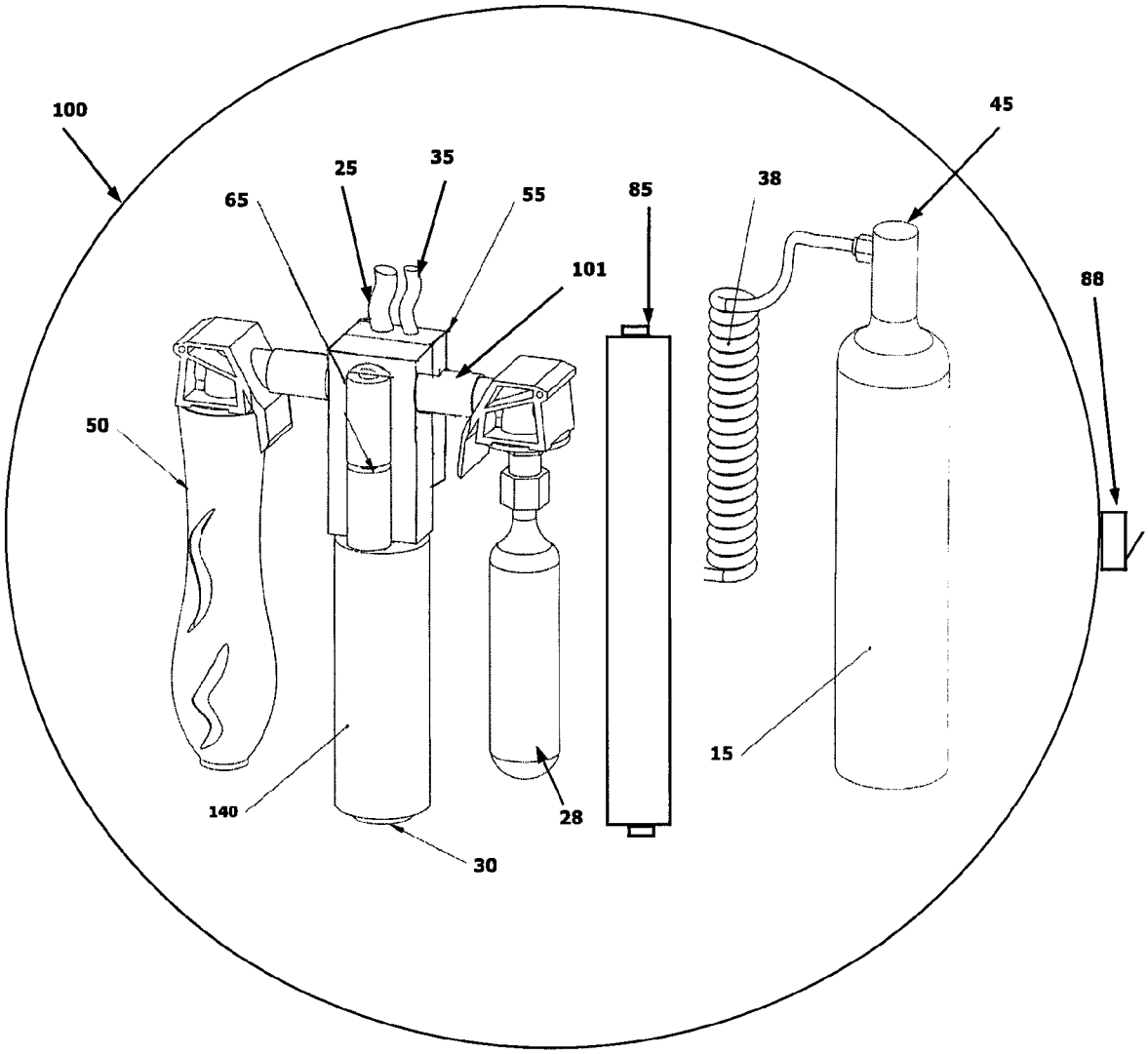
FIG. 4 is an embodiment whereby the compressed gas cylinders of the present invention are concealed under the base of a microphone stand.
Figure 5:
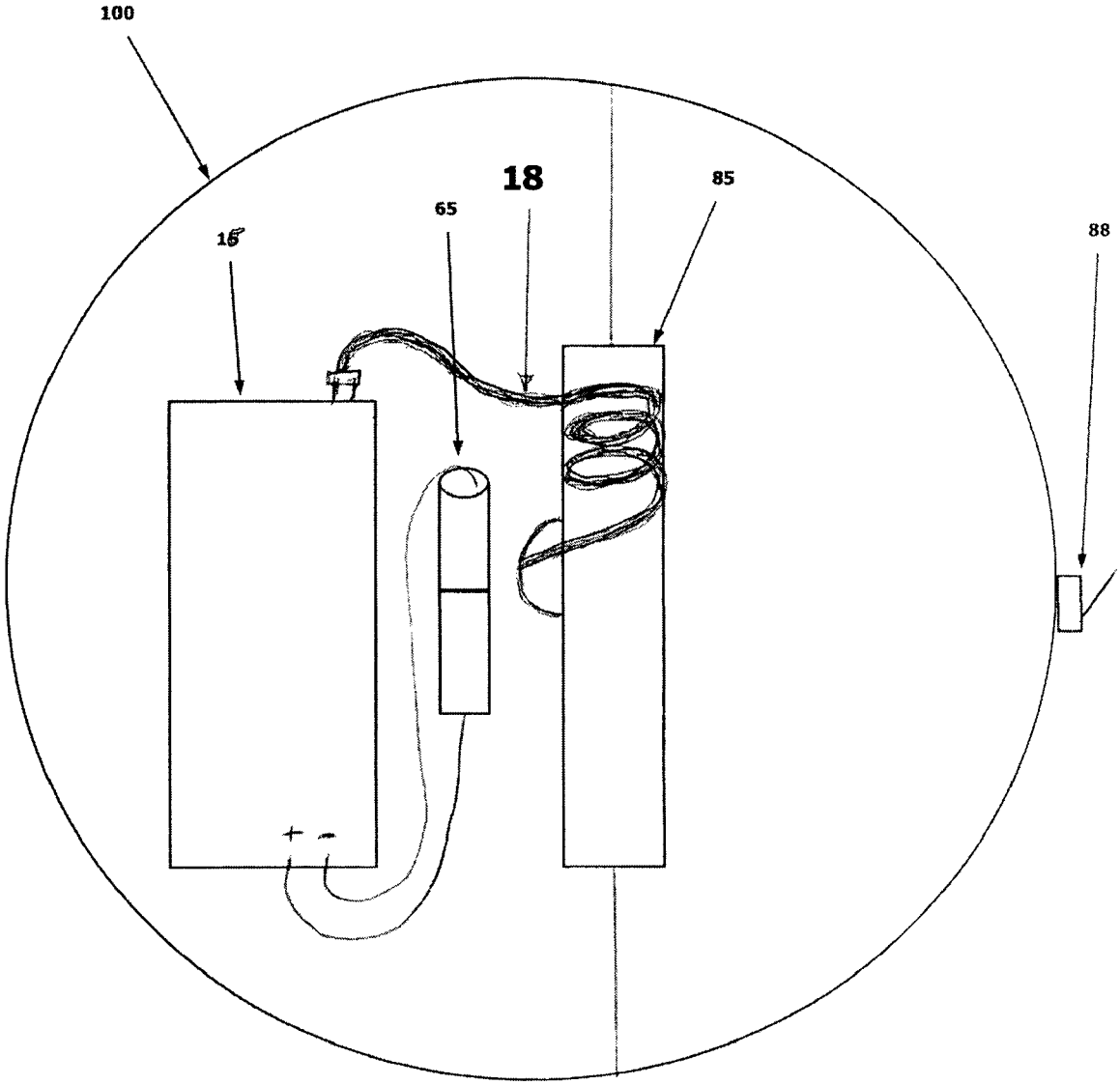
FIG. 5 is an embodiment incorporating a blower to produce airflow.
Figure 6:
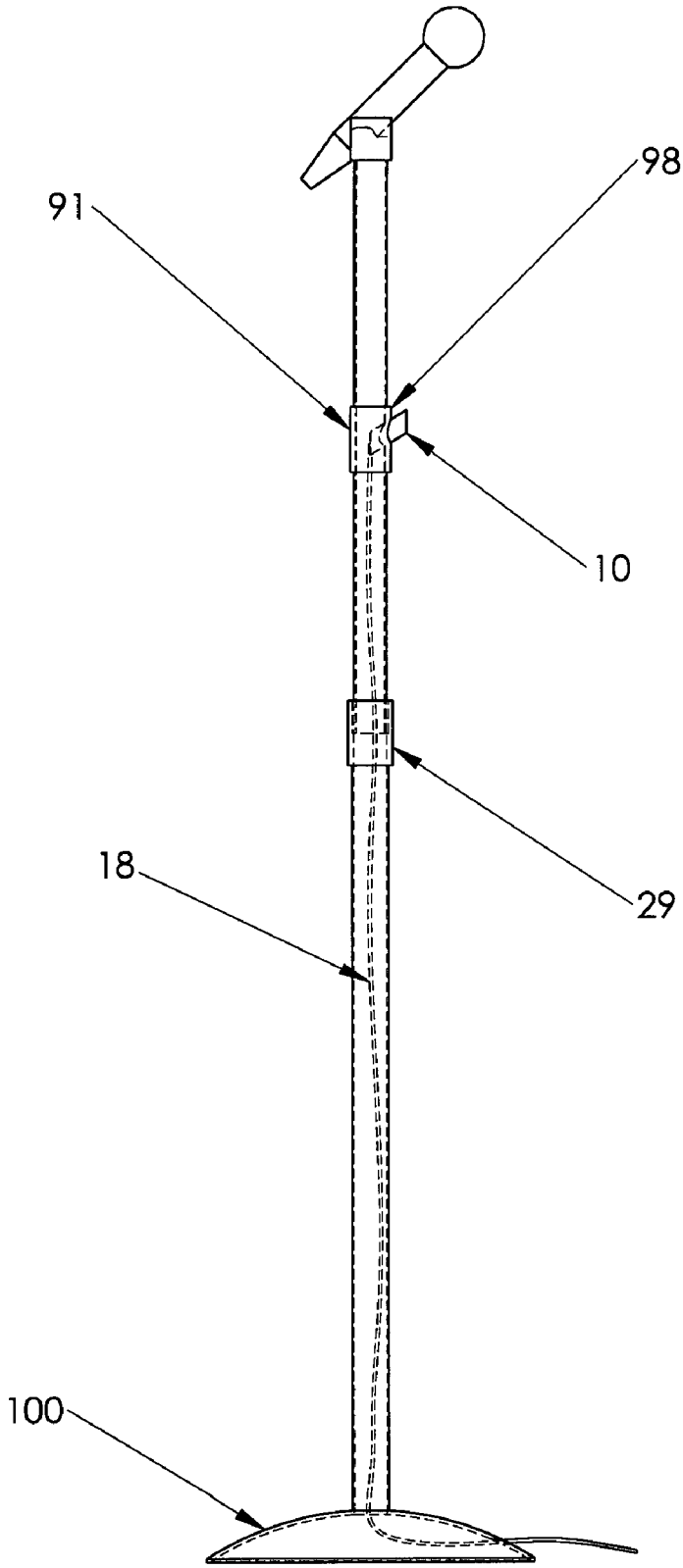
FIG. 6 is an embodiment demonstrating the snow generation tip protruding from a microphone stand to deliver evaporative snow in a clandestine manner.
Figure 7:
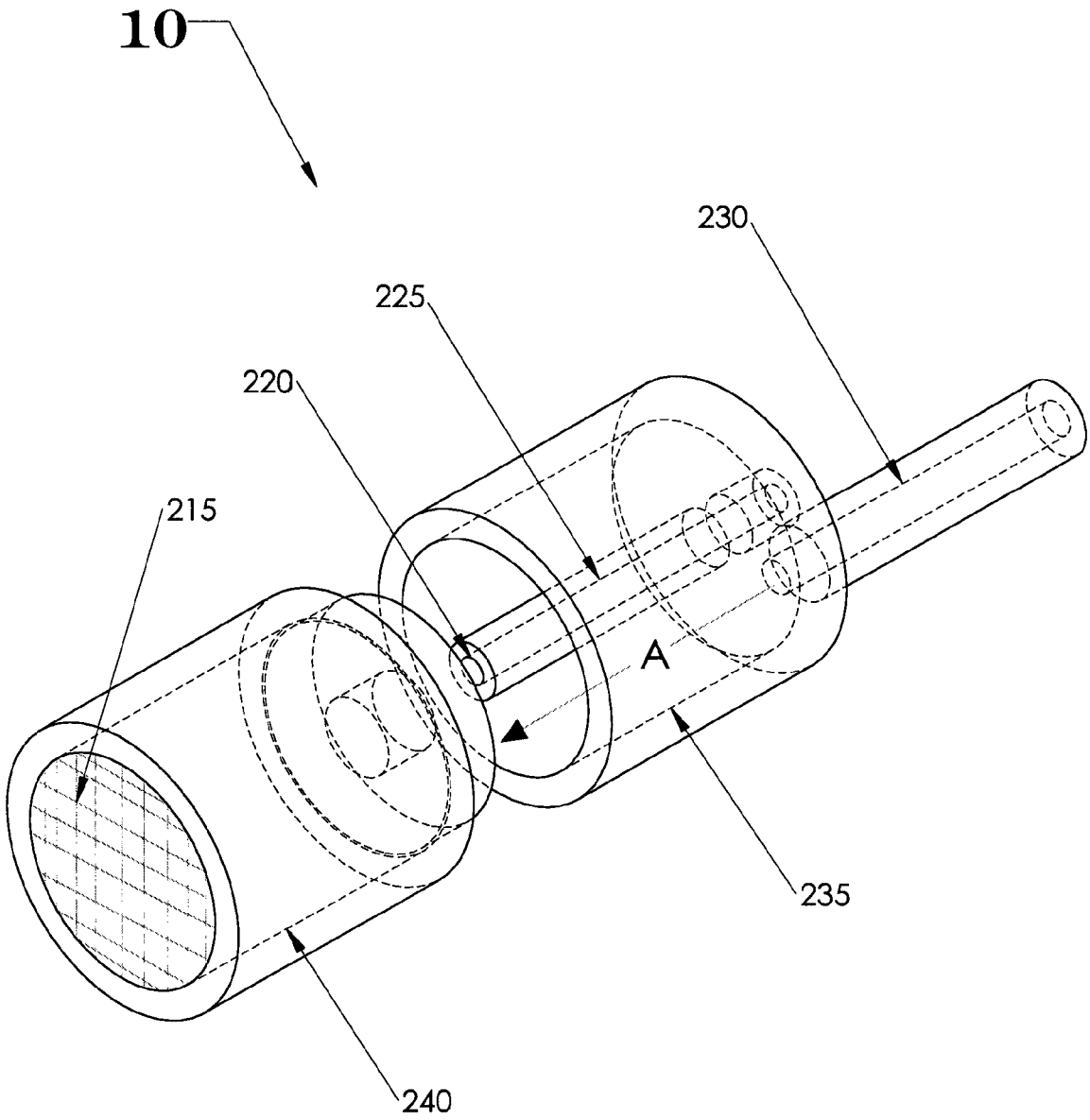
FIG. 7 is perspective close up of the snow generation tip interior of the present invention.

Compressed gas may be provided to compressed gas unit 6 by a compressed gas cylinder 15 that delivers compressed gas through a gas of hose 38 that connects to compressed gas unit 6 by any acceptable connecting mechanism. As depicted in FIG. 3, connection of compressed gas hose 38 is accomplished with a thumbscrew fitting 36 as is commonly known.

Solenoid 55 may further include a secondary regulator adjustment 30 to regulate the flow of gas when solenoid 55 is activated. Solenoid 55 may further be connected to a t-fitting connector 101 to allow to compressed gas cylinders 28 to be used with compressed gas unit 6.

In one environment of use, compressed gas unit 6 may be covered by a housing 100 that includes an external actuator 88 for activating solenoid 55.

Base 100 may also include snow generation unit 5. Optionally, the apparatus of the present invention may include a blower 16 that provides airflow.

In one environment of use, either one or both of snow generation unit 5 and compressed gas unit 6 may be concealed under housing 100 that forms the base of a conventional microphone stand.

A combined compressed gas/evaporative snow solution line 18 is configured correctly along microphone stand and position with a solution delivery tip holder 98 that holds snow generation tip 10 at an adjustable height in microphone stand middle adjustment 29 and microphone stand upper adjustment 91.

In use, the user will turn on the apparatus with on/off switch 50. The user will secure snow generation unit 5 to the forearm. Where the user raises their forearm in the air such that snow generation unit five is at an angle of 45° or greater relative to the horizontal plane tilt switch actuator 31 will trigger electronic solenoid 55. Compressed gas will travel from compressed gas cylinder 28 placed within housing 51 and the compressed gas will exit its compressed gas unit 6 through the air outlet 25. Compressed gas will travel through hose 80 into telescoping tip 130 traveling the length of telescoping tip 130 until the compressed gas enters snow generation tip 10 at compressed air inlet 230.

The compressed gas enters first chamber 235 and travels into second chamber 240. The negative pressure created within snow generation tip and draws evaporative snow solution from snow solution line 225 that causes the evaporative snow solution to travel through evaporative snow solution exiting outlet 220 and enter second chamber 240. When the evaporative snow solution in the second chamber 240 mixes with compressed gas and is pressed against membrane 215 individualized evaporative snowflakes are formed. The compressed gas of the apparatus push is the evaporative snowflakes outward from membrane 215 and evaporative snowflakes are propelled outward a way from snow generation tip 10.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. An apparatus for producing evaporative snow comprising:

(a) a snow generation unit consisting essentially of a fluid reservoir, a fluid delivery line and a snow generation tip;

(b) a compressed gas unit having at least one container of compressed gas, a source of electric power, and a gas regulator valve.

2. The apparatus of claim 1 wherein said fluid reservoir contains evaporative snow solution.

3. The apparatus of claim 1 wherein said compressed gas is carbon dioxide, atmospheric air, nitrogen, helium, or mixtures thereof.

4. The apparatus of claim 1 wherein said compressed gas is in two containers.

5. The apparatus of claim 1 wherein said source of electric power is delivered to the unit by batteries.

6. The apparatus of claim 1 wherein said source of electric power delivers between 3-24 volts.

7. The apparatus of claim 1 wherein the snow generation tip includes a membrane that provides a surface for the formation of evaporative snowflakes.

8. The apparatus of claim 1 wherein snow generation tip comprises a telescoping portion.

9. The apparatus of claim 8 wherein the snow generation tip is movable along the air inlet on the second end of a said telescoping tip.

10. The apparatus of claim 1 wherein the gas regulator valve is an electronically activated solenoid.

11. The apparatus of claim 1 wherein the gas regulator valve is an electronically activated solenoid controlled by a tilt switch actuator.

12. The apparatus of claim 11 wherein the tilt switch actuator activates the solenoid when oriented at an angle 45° or greater relative to the horizontal plane.

* * * * *